United States Patent [19]

Villa

[11] 4,364,741

[45] Dec. 21, 1982

[54] OIL SLURRIES OF CARBONACEOUS MATERIALS

[75] Inventor: Jose' L. Villa, Bridgewater, N.J.

[73] Assignee: Diamond Shamrock Corporation, Dallas, Tex.

[21] Appl. No.: 247,702

[22] Filed: Mar. 26, 1981

[51] Int. Cl.[3] ..... C10L 1/32

[52] U.S. Cl. ..... 44/51; 44/63

[58] Field of Search ..... 44/51, 63

[56] References Cited

U.S. PATENT DOCUMENTS

| | | | |
|---|---|---|---|
| 3,210,168 | 10/1965 | Morway . | |
| 4,069,022 | 1/1978 | Metzger . | |
| 4,147,519 | 4/1979 | Sawyer, Jr. | 44/51 |
| 4,201,552 | 5/1980 | Rowell et al. | 44/51 |
| 4,251,230 | 2/1981 | Sawyer, Jr. | 44/51 |

OTHER PUBLICATIONS

Schwartz et al., Surface Active Agents, vol. I, Interscience Publishers, Inc., New York, 1949, pp. 194–196.

J. M. Ekmann and D. Bienstock, "Stability of Coal–Oil Mixtures," presented at 1st International Symposium, Coal–Oil Mixture Combustion, St. Petersburg, Fla., May 8–10, 1978.

*Primary Examiner*—Jacqueline V. Howard

*Attorney, Agent, or Firm*—Leslie G. Nunn, Jr.

[57] ABSTRACT

Imidazoline quaternary salts are added to oil slurries of solid particulate carbonaceous material such as a coal oil mixture (COM) or a coke oil mixture to stabilize the slurry during storage and dispensing at various temperatures. The imidazoline quaternary salts are added to either the oil or slurry (or during the grinding of the carbonaceous material) and are effective with or without the addition of water. Coal/coke oil slurries may contain from about 40 to about 90 parts by weight of oil, about 10 to about 60 parts by weight of powdered coal or coke, about 0.01 to about 6.0 parts by weight of imidazoline quaternary salt and about 0 to about 10 parts by weight of water.

8 Claims, No Drawings

OIL SLURRIES OF CARBONACEOUS MATERIALS

BACKGROUND OF THE INVENTION

1. Field of the Invention

This invention relates to oil slurries of solid particulate carbonaceous material and more particularly to stabilized oil slurries of powdered coal or coke containing imidazoline quaternary salts as stabilizers.

2. Description of the Prior Art

Addition of solid particulate carbonaceous material, such as coal or coke, to a liquid hydrocarbon fuel, such as fuel oil, has been studied for many years. In the past five years, and particularly during the last two years, importance of reducing dependency of the world upon natural gas and liquid hydrocarbon fuels for its energy has been dramatically demonstrated.

Though not providing a complete solution to this energy problem, attempts have been made to incorporate solid particulate carbonaceous material, such as coal and coke, in liquid hydrocarbon fuels, because these particulate carbonaceous materials are far more plentiful than liquid fuels. There is considerable interest in extending and/or supplementing liquid fuels with solid fuels.

Many large industrial fuel users have equipment which was designed and constructed for the transportation, storage and combustion of liquid fuels. As yet, solid-liquid slurries, suspensions or emulsions are not accepted for regular use in such conventional equipment. In some instances this equipment was converted from its original design for burning solid fuels to liquid fuels. Many believe this trend should be reversed.

Various solutions to the problem of combining a solid particulate carbonaceous material with a liquid hydrocarbon fuel have been explored. One solution involved grinding carbonaceous material to colloidal size before introducing it into an oil. Even though this solution was successful, grinding costs were prohibitive. Coal oil slurries tend to form gels when heated to usable temperatures during storage, usually thixotropic gels.

Attempts were made to use the gelling phenomenon to hold larger than colloidal size particles in suspension. The gel was later broken down by adding additional oil so that the resulting slurry was pumpable without particulate material settling out. Inherently, this procedure was an expensive batch process.

Various materials were also added in an attempt to stabilize a coal oil slurry against settling of larger than colloidal size coal particles. Lime-rosin and starch were added to prevent settling of the larger slurry particles. Casein, gelatin and rubber were also added as suspension stabilizing agents to inhibit settling of coal particles. It was found that these suspension stabilizing agents must be added in quantities which undesirably thicken and increase viscosity of the slurry in order to prevent substantial quantities of coal particulate material from settling. Increasing slurry viscosity not only reduced the settling problem, but also limited uses to which the slurry may be put.

U.S. Pat. No. 4,069,022—Metzger, issued Jan. 17, 1978, describes a substantially water-free, high solid content, stable and combustible fuel slurry of about 5 to about 50 weight percent of a solid particulate carbonaceous material with the balance of the slurry being a liquid hydrocarbon fuel, a slurry suspension stabilizing agent and a water-free slurry viscosity reducing agent.

The viscosity reducing agent was present in an amount sufficient to maintain the slurry at a viscosity below about 300 seconds Saybolt Universal when the slurry is at a temperature of 175° F. Preferably, the viscosity reducing agent was a soap and the suspension stabilizing agent was starch.

The process for preventing formation of a gel in and controlling the settling and viscosity of this slurry involved the step of adding to the slurry containing a suspension stabilizing agent, a soap or salt of a fatty acid in an amount sufficient to maintain the viscosity of the slurry below 300 seconds Saybolt Universal when the slurry temperature was 175° F.

U.S. Pat. No. 3,210,168—Morway, issued Oct. 5, 1965, describes a stabilized slurry of pulverized coal coated with a liquid hydrocarbon fuel in water to make the slurry pumpable through a pipeline. The slurry is stabilized with an imidazoline surfactant having the formula:

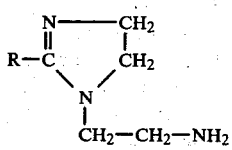

where R is an aliphatic hydrocarbon chain radical containing from 10 to 23 carbon atoms.

U.S. Pat. No. 4,201,552—Rowell et al., issued May 6, 1980, describe coal oil slurries stabilized with certain cationic surfactants having the group $$>N-CH_2-CH_2-O-$$

where the group forms part of a straight chain such as Ethomeen® C-20 or cyclic ring such as N-soya-N-ethyl morpholinium ethosulfate.

SUMMARY OF THE INVENTION

Imidazoline quaternary salts are added to oil slurries of solid particulate carbonaceous material such as a coal oil mixture (COM) or a coke oil mixture in an amount sufficient to stabilize the slurry during storage and dispensing at various temperatures. The imidazoline quaternary salt is added to either the oil or slurry (or during the grinding of the carbonaceous material) and is effective with or without the addition of water. Coal/coke oil slurries may contain from about 40 to about 90 parts by weight of oil, about 10 to about 60 parts by weight of powdered coal or coke, about 0.01 to about 6.0 parts by weight of imidazoline quaternary salt and about 0 to about 10 parts by weight of water. Useful quaternary salts include a quaternarized imidazoline which is a reaction product of oleic acid, aminoethylethanolamine and diethyl sulfate.

DETAILED DESCRIPTION

Imidazoline quaternary salts useful as stabilizers include 1-hydroxyalkyl 2-hydrocarbyl imidazoline quaternary salts having the formula:

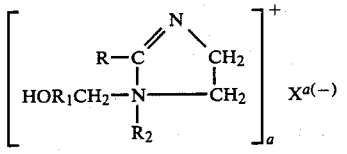

wherein:

R is a hydrocarbon radical having 9 to 23 carbon atoms, $R_1$ is a $$-CH_2- \quad \text{or} \quad -\overset{CH_3}{\overset{|}{C}}H- \quad \text{radical,}$$

$R_2$ is hydrogen, an unsubstituted or hydroxy-substituted aliphatic hydrocarbon radical having 1 to 6 carbon atoms or a benzyl radical, X is a water-soluble anion, and a is a number equal to the ionic valence of the anion, X.

Compounds of this general formula are known and may be made by quarternarizing (e.g. with a $C_1$–$C_6$ hydrocarbon or benzyl halide or sulfate) an imidazoline produced by the dehydration cyclization of an amide resulting from the reaction of a $C_{10}$ to $C_{24}$ aliphatic hydrocarbonoic acid and either 2-hydroxyethyl ethylene diamine or 2-hydroxyisopropyl ethylene diamine as described in U.S. Pat. Nos. 2,268,273 and 3,669,608.

In the imidazoline compounds used in this process, the $C_9$–$C_{23}$ aliphatic hydrocarbon radical, R, may be: saturated or unsaturated; linear, branched, or cyclic; and comprised of a mixture of the $C_9$–$C_{23}$ hydrocarbons. Illustrative of acids that may be used in producing the compounds and form the hydrocarbon radical thereof are lauric, palmitic, stearic, erucic, oleic, linoleic, linolenic and tallow acids. As will be appreciated, the commercial technical grades of these and other acids, which may be used to produce the imidazoline compounds by the exemplary process hereinbefore described, normally contain considerable minor quantities of hydrocarbons outside the $C_{10}$ to $C_{18}$ range, and that, therefore, the imidazoline compounds prepared from such acids and used in the invention process may contain minor quantities of compounds having 2-hydrocarbyl groups having less than 9 carbons or more than 23 carbons.

$R_2$ is any unsubstituted or hydroxysubstituted hydrocarbon radical having 1 to 6 carbon atoms that is linear, branched, or cyclic, and either saturated or unsaturated, or may be a benzyl radical when the imidazoline compounds used are produced by quaternarization as for example, with a $C_1$–$C_6$ hydrocarbon or benzyl halide or sulfate or with an active epoxide such as ethylene or propylene oxide.

The anion, X, is not critical and may be $$Cl^-,\ Br^-,\ CH_3COO^-,\ C_2H_5SO_4^-,\ CH_3SO_4^-$$

or like anion. Generally preferred, because of their lower costs, are the chloride, methosulfate and ethosulfate anions.

The term "carbonaceous," as used herein, encompasses solid particulate carbonaceous fossil fuel materials which have been powdered or pulverized to a size where 80% or more will pass through a 200 mesh screen. Useful carbonaceous materials include bituminous and anthracite coals, coke, petroleum coke, lignite, charcoal, peat, admixtures thereof and the like. The teachings relating to these materials, oils and carbonaceous oil slurries in U.S. Pat. No. 4,069,022—Metzger, issued Jan. 17, 1978, are incorporated by reference herein.

Oils suitable for these slurries include fuel oils such as No. 6 fuel oil, No. 2 fuel oil as well as other liquid petroleum products such as gas oils and crude oils used as fuel oils or the like.

Powdered coal used in these slurries may be pulverized bituminous, anthracite, or semi-bituminous coal. If desired, finely-divided solid carbonaceous materials such as powdered coke from coal or petroleum may be used in these slurries.

At room temperature, when a uniformly mixed coal oil slurry or coke oil slurry is prepared, the viscous fuel oil usually holds powdered coal in suspension. Later, when the coal oil slurry is heated so that the slurry can be pumped, the oil viscosity decreases and coal particles tend to settle. The quantity of dispersant added initially to the coal oil slurry should be sufficient to keep the coal particles suspended at elevated temperatures. To test the stabilizing effect of various additives, coal oil mixtures are prepared and then heat aged. The following procedure is useful in the evaluation of these coal oil and coke oil slurries with quaternarized imidazolines and their salts as slurries with stabilizers.

| | |
|---|---|
| APPARATUS | 1. One gallon jars with lids. |
| | 2. High speed laboratory stirrer. |
| | 3. Glass rod. |
| | 4. Glass jars with lids, 4 oz. |
| | 5. Constant temperature bath. |
| REAGENTS | 1. Fuel Oil No. 6. |
| | 2. Powdered coal 70 to 90% through 200 mesh. |
| PROCEDURE | 1. Prepare a uniform coal in oil mixture in a one gallon jar. Disperse coal into heated oil kept between 55°–70° C. using agitation with a laboratory high speed stirrer. Agitation should continue until no lumps of coal are present in the mixture. |
| | 2. Repeat 1 using different coal to oil ratios to encompass the range of 90 oil/10 coal to 40 oil/60 coal. |
| | 3. Weigh aliquots of 100 g of coal in oil mixtures into 4 oz jars. |
| | 4. Add desired amount of stabilizer to each 100 g of coal in oil mixture. Seal system by tightly closing lid. Preferred level of addition for screening purposes is 0.5 g of stabilizer per 100 g of coal in oil mixture, i.e., 0.5 pph (0.5 part per hundred by weight). Thus, test a series of stabilizers simultaneously |
| | 5. Place all jars into a constant temperature bath kept at designated temperature and age samples. |
| | 6. Check settling of coal to bottom of the jar every 24 hours. If coal has settled to the bottom of the jar, reject the stabilizer and proceed aging with the remaining jars. |
| | 7. Check the degree of settling of coal to the bottom of the jar by slowly inserting a glass rod into the coal in oil mixture until it penetrates any sediment and hits the bottom of the jar. If the rod slides uninhibited by any coal sediment to the bottom of the jar, the |

-continued

| | |
|---|---|
| | stabilizer is acceptable. However, if the penetration of the rod is retarded by thickening of the mixture at the bottom of the jar or by a coal sediment at the bottom of the jar, the stabilizer should be rejected. |

For a fuller understanding of the nature and advantages of this invention, reference may be made to the following examples. These examples are given merely to illustrate the invention and are not to be construed in a limiting sense. All quantities, proportions and percentages are by weight and all references to temperature are °C. unless otherwise indicated.

EXAMPLE I

A coal oil slurry was stabilized with a quaternarized imidazoline which was the reaction product of oleic acid, aminoethylethanolamine and diethyl sulfate.

Coal oil slurries were prepared using 40% by weight of powdered coal, of which over 80% passed through a 200 mesh sieve, 60% by weight of fuel oil No. 6 high viscosity having a Saybolt viscosity of 263 seconds at 122° F. and between 0 and 1% by weight of the quaternarized imidazoline as a stabilizer.

Samples of the stabilized and unstabilized (control) coal oil slurries were placed in an oven at 60°-65° C. to accelerate sedimentation of coal particles. Sedimentation of each slurry was checked by slowly inserting a glass rod into the coal oil slurry until it penetrated any sediment or touched the bottom of the jar. After 16 hours (overnight) practically all of the coal particles in the unstabilized slurry had settled to the bottom of the jar, forming a hard packed sediment. Results of testing with several levels of stabilizer are as follows:

| pph Additive | pph Water Added | Stability |
|---|---|---|
| 1 | 0 | slight sedimentation after 2 weeks |
| 0.5 | 0 | slight sedimentation after 10 days |
| 0.25 | 0 | soft dispersible sediment after 8 days |
| 0.25 | 3 | slight soft sediment after 7 days |
| 0 | 3 | packed sediment within 2 days |

EXAMPLE II

Coal oil slurries were prepared using 40% by weight of powdered coal of which 80% passed through a 200 mesh sieve, 60% by weight of No. 6 fuel oil having a low viscosity of 26 seconds at 122° F. and 0% to 1% by weight of the quaternarized imidazoline stabilizer described in Example I. The coal oil slurries were placed in an oven at 65°-70° C. to accelerate sedimentation. Results are as follows:

| pph Additive | pph Water Added | Stability |
|---|---|---|
| 1 | 0 | slight drop at day 8 |
| 0.5 | 0 | no sediment at day 10 |
| 0.25 | 0 | slight dusting at day 7 |
| 0 | 0 | packed sediment at day 3 |
| 1 | 3 | slight dusting at day 11 |

EXAMPLE III

Coal oil slurries were prepared and evaluated using 30% by weight of powdered coal of which over 80% passed through a 200 mesh sieve, 70% by weight of low viscosity fuel oil No. 6 and 0 to 0.5% by weight of the quaternarized imidazoline described in Example I as the stabilizer using the evaluation procedure described in the specification. After 1 day storage at 82° C. practically all of the coal particles in the unstabilized slurry had settled to the bottom of the jar. After 12 days storage at 81° C., the slurry containing 0.25 pph of the stabilizer had a slight soft sediment. A coal oil slurry with 0.25 pph stabilizer and 3 pph water showed no signs of sedimentation after 2 weeks.

EXAMPLE IV

A coal oil slurry was stabilized with a quaternarized imidazoline which was the reaction product of tall oil fatty acid, aminoethylethanolamine and diethyl sulfate.

Coal oil slurries were prepared using 40% by weight of powdered coal, of which over 80% passed through a 200 mesh sieve, 60% by weight of fuel oil No. 6 high viscosity having a Saybolt viscosity of 263 seconds at 122° F. and between 0 and 1% by weight of the quaternarized imidazoline as a stabilizer.

Samples of the stabilized and unstabilized (control) coal oil slurries were placed in an oven at 65°-70° C. to accelerate sedimentation of coal particles. Sedimentation of each slurry was checked by slowly inserting a glass rod into the coal oil slurry until it penetrated any sediment or touched the bottom of the jar. After 16 hours (overnight) practically all of the coal particles in the unstabilized slurry had settled to the bottom of the jar, forming a hard packed sediment. The COM stabilized with 0.5 pph of the stabilizer had only a slight sedimentation after 7 days.

EXAMPLE V

Coal oil slurries were prepared using 40% by weight of powdered coal of which 80% passed through a 200 mesh sieve, 60% by weight of No. 6 fuel oil having a low viscosity of 26 seconds at 122° F. and 0% to 1% by weight of the quaternarized imidazoline stabilizer described in Example IV. The coal oil slurries were placed in an oven at 65°-70° C. to accelerate sedimentation. Results are as follows:

| pph Additive | Stability |
|---|---|
| 0 | packed sediment at day 2 |
| 1.0 | slight sediment at day 7 |
| 0.5 | slight sediment at day 7 |

EXAMPLE VI

A coal oil slurry was stabilized with a quaternarized imidazoline which was the reaction product of oleic acid, aminoethylethanolamine and benzyl chloride.

Coal oil slurries were prepared using 40% by weight of powdered coal, of which over 80% passed through a 200 mesh sieve, 60% by weight of fuel oil No. 6 medium viscosity having a Saybolt viscosity of 136 seconds at 122° F. and between 0 and 1% by weight of the quaternarized imidazoline as a stabilizer. Samples of the stabilized and unstabilized coal oil slurries were placed in an oven at 60°-65° C. to accelerate sedimentation of coal particles. After 2 days practically all of the coal particles in the unstabilized slurry had settled out forming a hard packed sediment. The slurry stabilized with 1.0 pph of the quaternarized imidazoline had no sediment of coal particles after 1 week.

EXAMPLE VII

Coal oil slurries were prepared and evaluated using 30% by weight of powdered coal of which over 70% passed through a 200 mesh sieve, 70% by weight of medium viscosity fuel oil No. 6 with Saybolt viscosity of 163 seconds at 122° F. and 0 to 0.5% by weight of the quaternarized imidazoline described in Example VI as the stabilizer using the evaluation procedure described in the specification. Samples were heat aged at 60°–65° C. to accelerate sedimentation.

After 2 days, the unstabilized slurry had a hard packed sediment. The slurry stabilized with 1.0 pph of the quaternarized imidazoline had only a slight drop of particles after 1 week.

EXAMPLE VIII

Coal oil slurries were prepared using 40% by weight of powdered coal of which 80% passed through a 200 mesh sieve, 60% by weight of No. 6 fuel oil having a low viscosity of 26 seconds at 122° F. and 0% to 1% by weight of the quaternarized imidazoline stabilizer described in Example VI. The coal oil slurries were placed in an oven at 60°–65° C. to accelerate sedimentation. The unstabilized slurry had a hard packed sediment after 3 days. The slurry stabilized with 1.0 pph of quaternarized imidazoline had only a slight drop of particles after 1 week.

While the invention has been described with reference to certain specific embodiments thereof, it is understood that it is not to be so limited since alterations and changes may be made therein which are within the full and intended scope of the appended claims.

What is claimed is:

1. An oil slurry of solid particulate carbonaceous material having an imidazoline quaternary salt of the formula

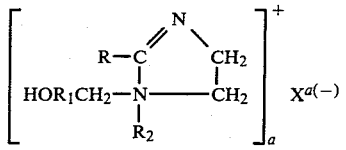

wherein:

R is a hydrocarbon radical having 9 to 23 carbon atoms, $R_1$ is a $$-CH_2- \quad \text{or} \quad -\overset{\overset{\displaystyle CH_3}{|}}{CH}- \quad \text{radical,}$$

$R_2$ is hydrogen, a unsubstituted aliphatic hydrocarbon radical having 1 to 6 carbon atoms, a hydroxy-substituted aliphatic hydrocarbon radical having 1 to 6 carbon atoms or a benzyl radical, X is a water-soluble anion, and a is a number equal to the ionic valence of the anion, X, present in an amount sufficient to stabilize the slurry at elevated temperatures.

2. The slurry of claim 1 wherein the quaternary salt is a reaction product of oleic acid, aminoethylethanolamine and diethyl sulfate.

3. The slurry of claim 1 wherein powdered coal is present.

4. The slurry of claim 1 wherein powdered coke is present.

5. The slurry of claim 1 wherein there is present from about 40 to about 90 parts by weight of oil, about 10 to about 60 parts by weight of particulate carbonaceous material, about 0.01 to about 6 parts by weight of the imidazoline quaternary salt and from about 0 to about 10 parts by weight of water.

6. The slurry of claim 1 wherein the quaternary salt is a reaction product of oleic acid, aminoethylethanolamine and benzyl chloride.

7. The slurry of claim 1 wherein the quaternary salt is a reaction product of tallow, aminoethylethanolamine and diethyl sulfate.

8. The slurry of claim 5 wherein the quaternary salt is a reaction product of oleic acid, aminoethylethanolamine and diethyl sulfate.

* * * * *